US007144292B2

(12) United States Patent
Schouten

(10) Patent No.: US 7,144,292 B2
(45) Date of Patent: Dec. 5, 2006

(54) FLYING DISC

(76) Inventor: Pieter Schouten, 2414 Dowling Pl., Berkeley, CA (US) 94705

( * ) Notice: Subject to any disclaimer, the term of this patent is extended or adjusted under 35 U.S.C. 154(b) by 0 days.

(21) Appl. No.: 10/903,618

(22) Filed: Jul. 30, 2004

(65) Prior Publication Data

US 2005/0059315 A1 Mar. 17, 2005

(51) Int. Cl.
*A63H 27/127* (2006.01)

(52) U.S. Cl. ..... 446/46; 446/256

(58) Field of Classification Search ..... 446/46, 446/48, 61, 256; D21/437; 206/307, 308.1
See application file for complete search history.

(56) References Cited

U.S. PATENT DOCUMENTS 4,351,129 A * 9/1982 Kerkenbush et al. ..... 446/46
6,227,363 B1 * 5/2001 Lu ..... 206/308.1
6,516,852 B1 * 2/2003 Sandor ..... 156/391
6,585,551 B1 * 7/2003 McClung et al. ..... 446/46
6,749,061 B1 * 6/2004 Clausen ..... 206/308.1
6,874,625 B1 * 4/2005 Chang ..... 206/308.1
6,886,687 B1 * 5/2005 Bolongia et al. ..... 206/308.1

* cited by examiner

*Primary Examiner*—Kien Nguyen
(74) *Attorney, Agent, or Firm*—George R. McGuire; Bond, Schoeneck & King, PLLC

(57) ABSTRACT

The present invention provides a flying disc comprising a rigid or semi-rigid ring having upper and lower portions hingedly connected to one another, with each of the upper and lower surfaces including means for retaining a pliable body therebetween. For instance, a tortilla or similar food product characterized by its disc-like shape and flexible nature may be positioned between the upper and lower surfaces of the ring. The upper and lower portions include structure for securely retaining the flexible body therebetween.

3 Claims, 6 Drawing Sheets

FLYING DISC

BACKGROUND OF THE INVENTION

1. Field of the Invention

The present invention relates generally to flying discs, and more particularly to flying discs that incorporate a flexible food product as a part thereof.

Flying discs have long been an amusement device. Flying discs are typically composed of rigid or semi-rigid plastic and formed in the shape of a disc with a concave bottom surface, thereby giving the disc effective aerodynamic characteristics. More recently, flying discs have been composed of flexible material, such as cloth, and have also taken on forms other than circular. The most popular flying disc has been the disc sold under the trademark FRISBEE®.

Aside from their typical use, flying discs are also used in crowded places, such as concerts and graduation ceremonies. When used in these venues, the flying disc is oftentimes lost.

It is therefore a principal object and advantage of the present invention to provide a flying disc that is inexpensive to manufacture, and that may be either disposable or reusable. It is another object and advantage of the present invention to use biodegradable material as part of the disc's composition.

Other objects and advantages of the present invention will in part be obvious and in part appear hereinafter.

3. Objects and Advantages

It is therefore a principal object and advantage of the present invention to

SUMMARY OF THE INVENTION

In accordance with the foregoing objects and advantages, the present invention provides a flying disc comprising a rigid or semi-rigid ring having upper and lower portions hingedly connected to one another, with each of the upper and lower surfaces including means for retaining a food product, such as a tortilla, therebetween. A tortilla or similar food product characterized by its disc-like shape and flexible nature is intended to be positioned between the upper and lower surfaces of the ring. The upper and lower surfaces may then be hingedly interlocked retaining the tortilla between them. The rigid or semi-rigid nature of the ring provides the disc with the rigidity necessary to effectively fly through the air, while the tortilla provides the aerodynamic shape that also permits the device to effectively fly through the air when thrown in a spinning motion in a relatively radial direction.

BRIEF DESCRIPTION OF THE DRAWINGS

The present invention will be more fully understood and appreciated by reading the following Detailed Description in conjunction wit the accompanying drawings, wherein.

DETAILED DESCRIPTION

Figure 12:
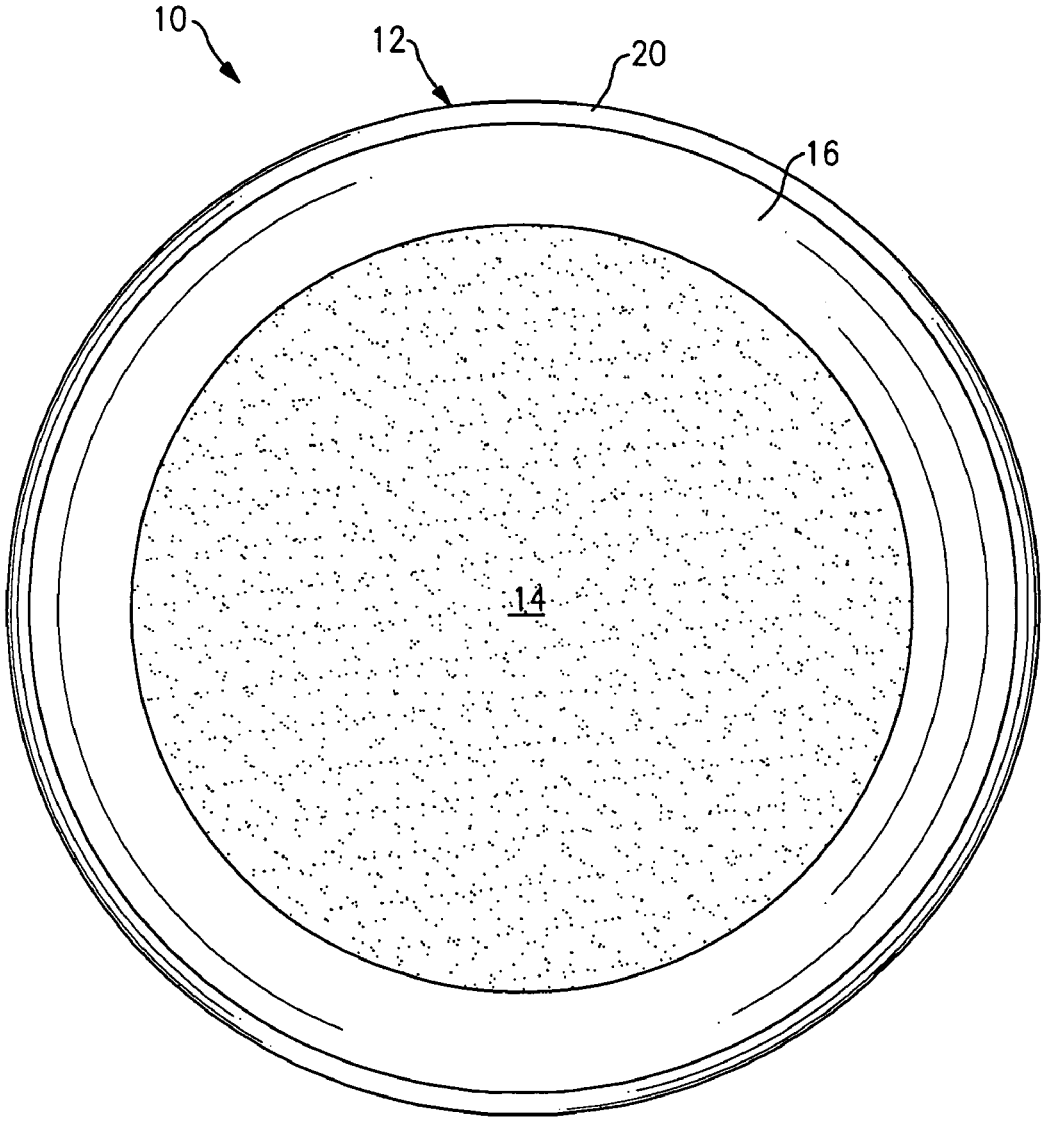
FIG. 12 is a top plan view of the present invention.

Referring now to the drawing figures, there is seen in FIG. 12 a flying disc, designated generally by reference numeral 10, comprising a circumferential ring portion 12 and a centrally positioned, disc-shaped food portion 14. Food portion 14 is preferably a soft flour tortilla, but may be other flexible food product or biodegradable substance. With all embodiments of the present invention, ring portion 12 comprises upper portion 16 and lower portion 18 joined together along a hinge 20, and food product 14 is securely retained between upper portion 16 and lower portion 18 by various means that will be disclosed hereinafter.

Figure 1:
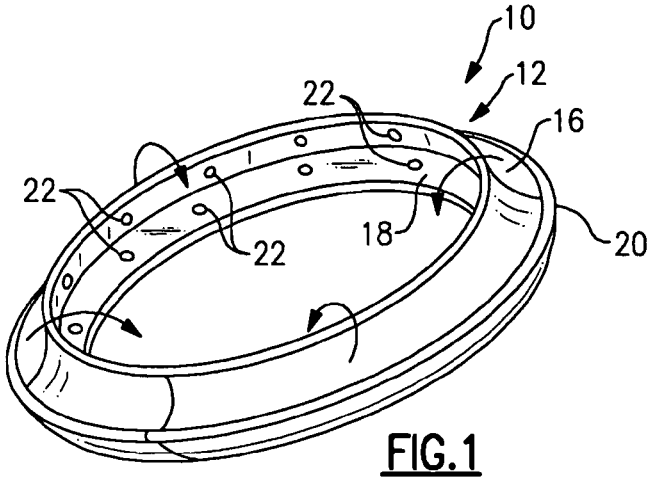
FIG. 1 is a perspective view of a first embodiment of a ring portion of a flying disc.
Figure 2:
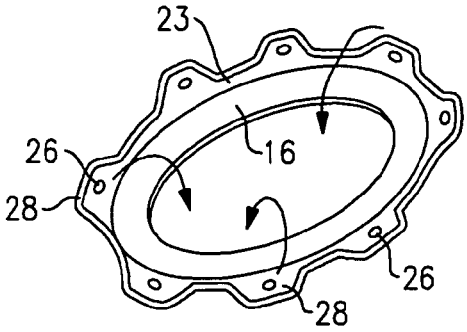
FIG. 2 is a perspective view of a second embodiment of the ring portion of the present invention in an open position.
Figure 5:
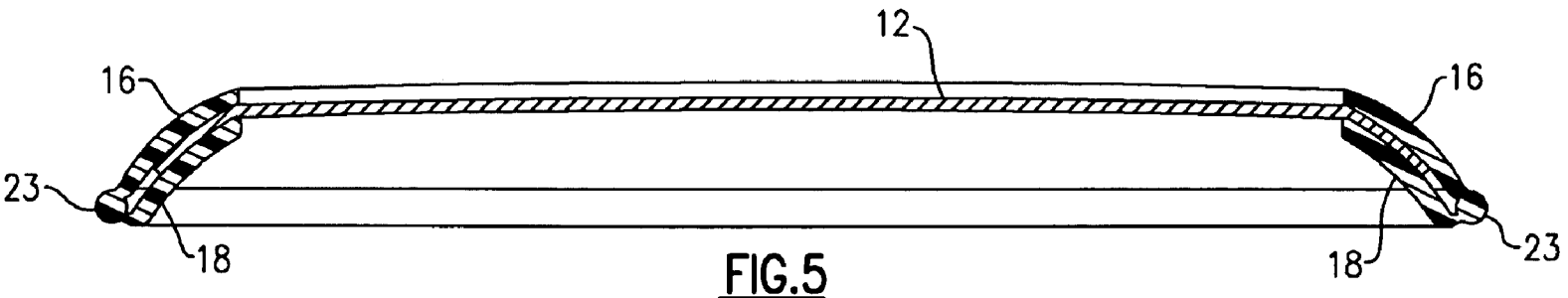
FIGS. 5 and 6 are cross-sectional side elevation views of the present invention in closed and open positions, respectively.
Figure 6:
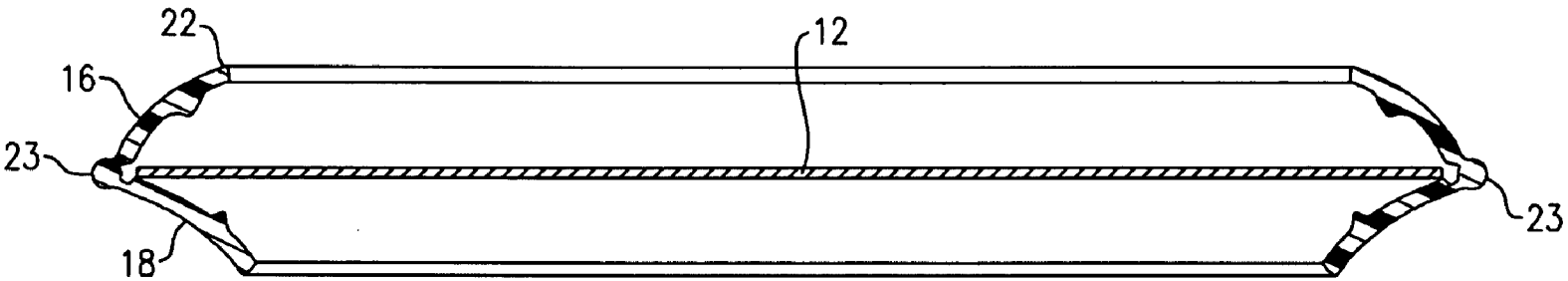
Figure 7:
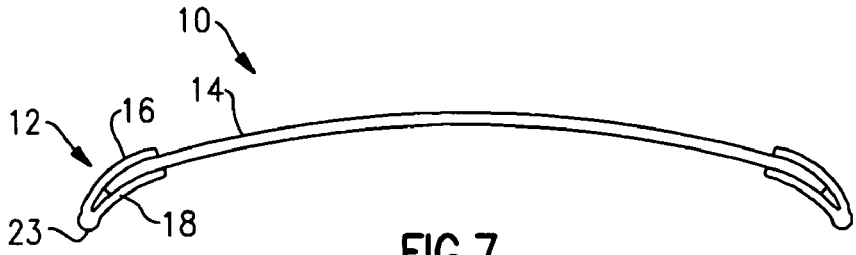
FIG. 7 is an assembled side elevation view of the present invention.
Figure 8:
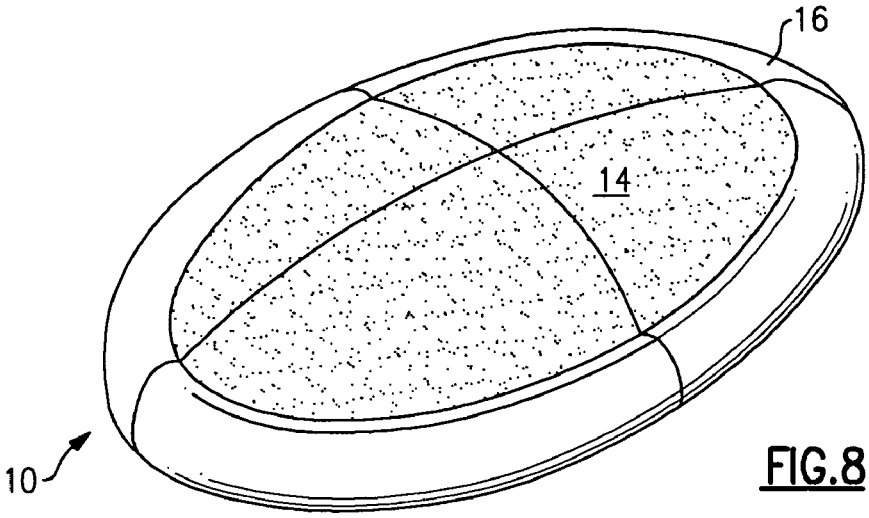
FIG. 8 is a perspective view of the assembled present invention.
Figure 9:
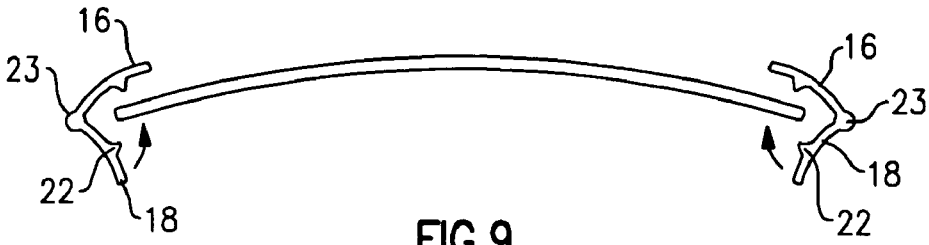
FIG. 9 is an exploded side cross-sectional side elevation view of the present invention (first embodiment)
Figure 10:
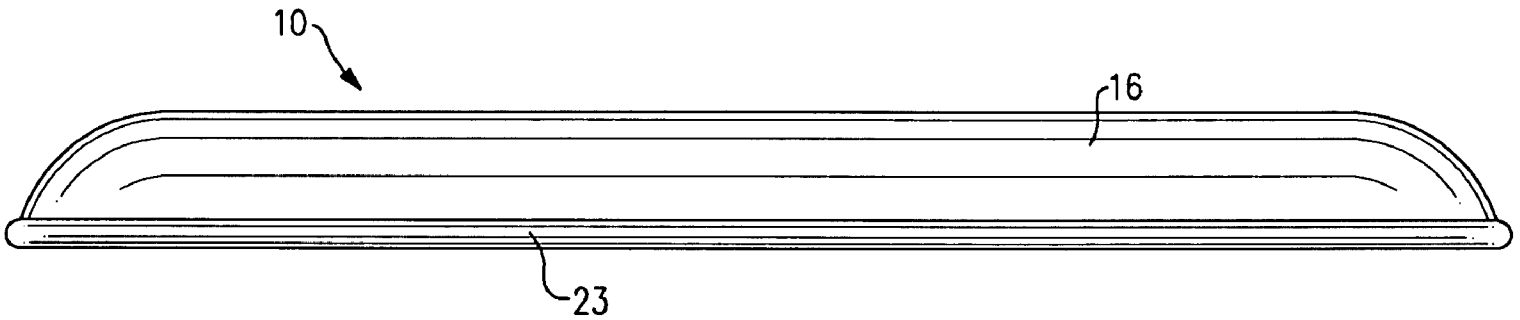
FIGS. 10 and 11 are side elevation views of the present invention in its closed and open positions, respectively.
Figure 11:
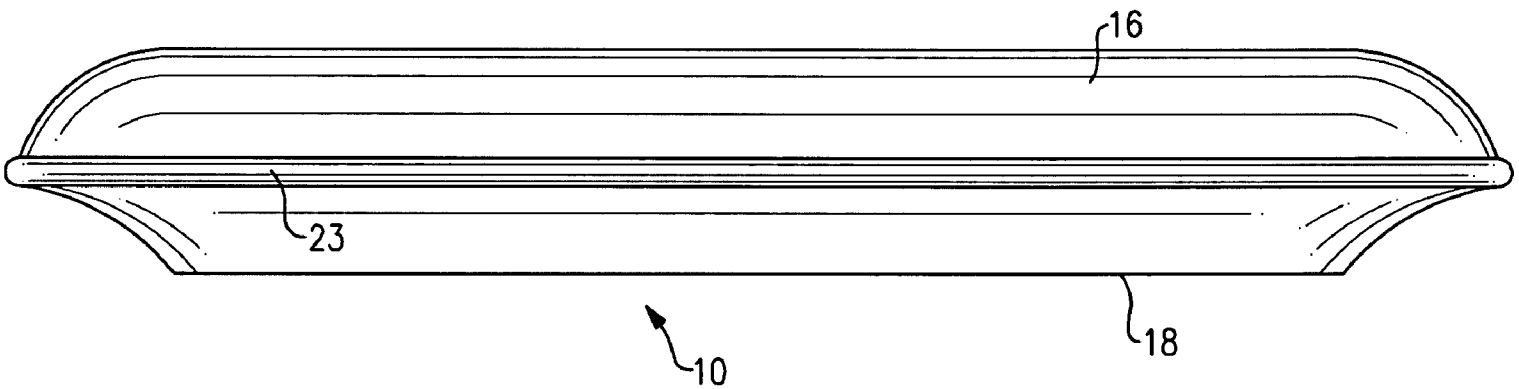

With reference to FIG. 1, the means for securely retaining food product 14 (not shown in FIG. 1) between upper portion 16 and lower portion 18 is a series of circumferentially spaced apart teeth 22 formed on the inwardly facing surfaces of the upper and lower portions. Teeth 22 engage the food product when lower portion 18 is hingedly moved from its open position (see FIGS. 6 and 11) to its closed position (see FIGS. 5 and 10). The hinged movement of lower portion 18 is achieved by having a living hinge 23 at the junction of the upper and lower portions.

Figure 3:
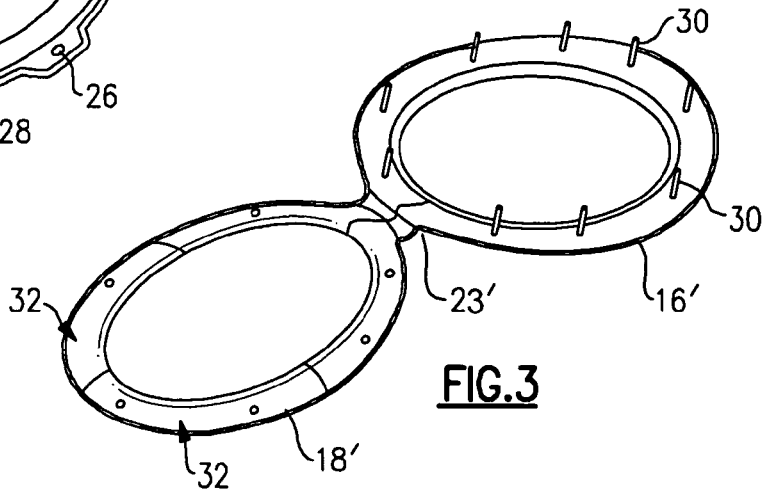
FIG. 3 is a perspective view of a third embodiment of the ring portion of the present invention in an open position.

The embodiments illustrated in FIGS. 2, and 4–12 each utilize a living hinge 23 formed around the entire periphery of ring portion 12, while the embodiment of FIG. 3 utilizes a living hinge 23' that is formed only along a portion of the circumference, with the upper and lower portions only being permanently joined along that limited circumferential portion, thereby forming a clamshell-type arrangement.

Figure 4:
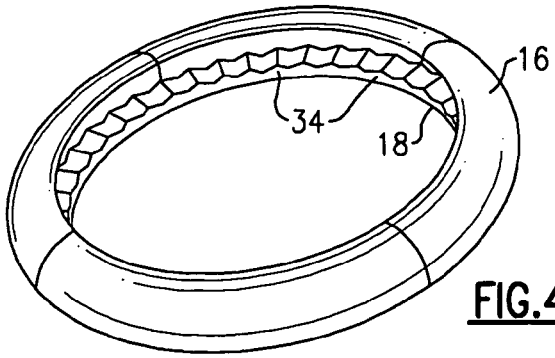
FIG. 4 is a perspective view a fourth embodiment of the ring portion of the present invention.

The means for securely retaining the food product further include the following: teeth 26 formed on the inwardly facing surface of only the lower region 18' which may be formed as a series of circumferentially spaced apart tabs 28, as opposed to a continuous ring (see FIG. 2); a series of circumferentially spaced apart posts 30 formed on the inwardly facing surface of the upper portion 16' and that extend through a food product and openings 32 formed through the lower portion 18' (see FIG. 3); and a continuous series of serrations 34 (e.g. a zipper lock pattern) formed in both the upper and lower portions 16, 18 (see FIG. 4).

Figure 13:
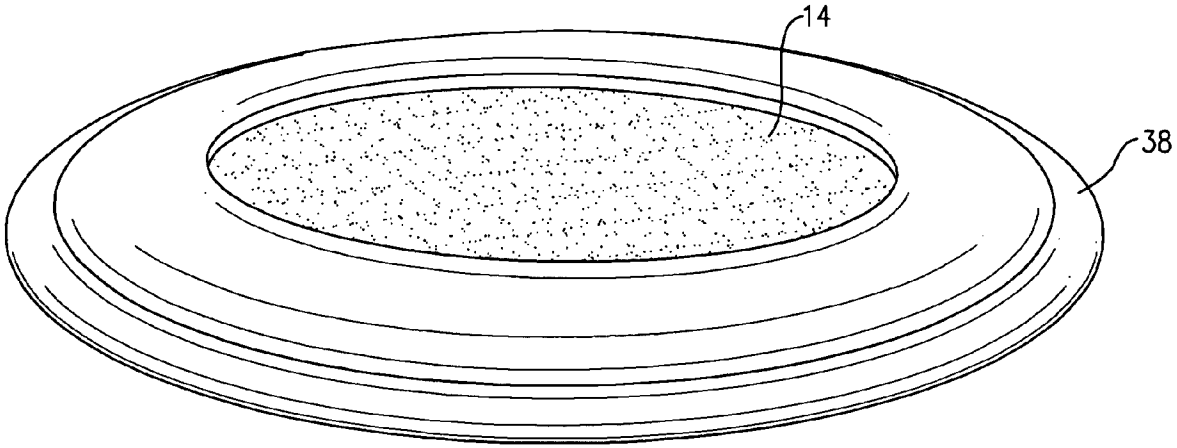
FIG. 13 is a perspective view of a fourth embodiment of the present invention.
Figure 14:
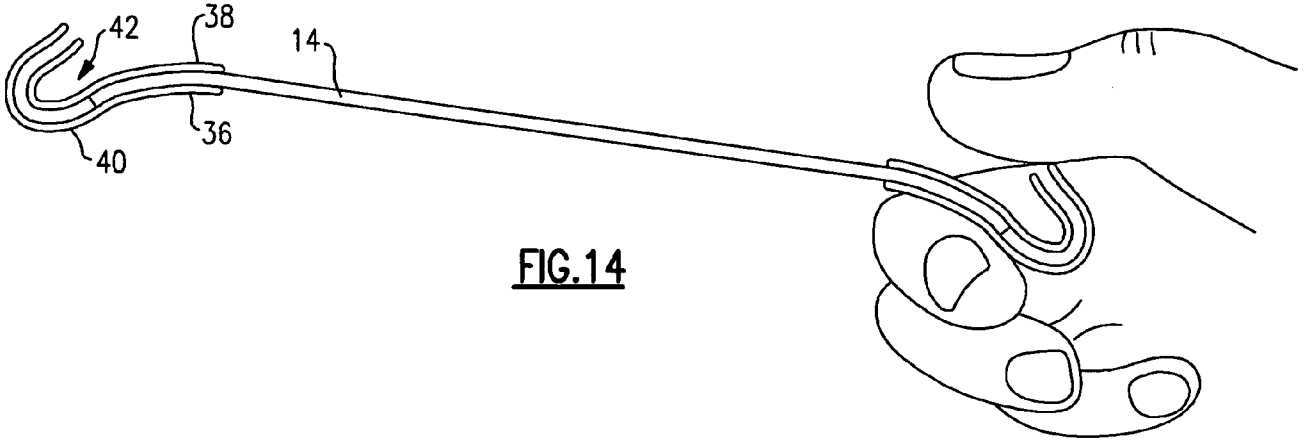
FIG. 14 is a cross-sectional side elevation view thereof.

Referring to the embodiment illustrated in FIGS. 13 and 14, food product 14 is secured between upper and lower interlocking ring portions, 36, 38, respectively. Food product 14 is placed over the edge of either upper or lower portion 36 or 38, and then the other of upper or lower ring portion 36 or 38 is snap engaged into the other ring portion sandwiching food product 14 therebetween. Ring portions 36 and 38 each include a U-shaped groove 40, 42, respectively, formed along their edges. Ring portions 36, 38 are made of a resilient, semi-rigid material, and U-shaped grooves 40, 42 are sized in a complementary relationship to one another so as to permit the effective engagement of one into the other. In addition to offering the snap engagement utility, the curved edges of the ring portions provide a good finger grip surface when throwing the disc, and enhance the aerodynamic (lift) characteristics of the disc by entrapping air therein.

What is claimed is:

1. A frame for securely holding a flexible body that forms a flying disc, comprising:

a) an upper frame portion forming a first ring;

b) a lower frame portion forming a second ring and hingedly connected to said upper frame portion for movement between open and closed positions; and c) means for retaining the flexible body between said upper and lower frame portions positioned along said first ring and said second ring, wherein said means for retaining the flexible body comprises said upper and lower frame portions each having inwardly facing surfaces on which a series of circumferentially spaced apart teeth are formed, whereby said teeth engage the flexible body when said upper and lower frame portions are in a closed relationship.

2. The frame according to claim 1, wherein the flexible body is a tortilla.

3. A frame for securely holding a flexible body that forms a flying disc, comprising:

a) an upper frame portion forming a first ring;

b) a lower frame portion forming a second ring and hingedly connected to said upper frame portion for movement between open and closed positions; and c) means for retaining the flexible body between said upper and lower frame portions positioned along said first ring and said second ring, wherein said upper and lower frame portions include means for snappingly engaging one another and securely rotating the flexible body therebetween.

* * * * *